United States Patent [19]

Sado

[11] Patent Number: 4,525,606

[45] Date of Patent: Jun. 25, 1985

[54] SENSOR SWITCH

[76] Inventor: Ryoichi Sado, Oaza Kobari Shinjuku 69-7, Ina-cho, Kita-adachi-gun, Saitama-ken, Japan

[21] Appl. No.: 462,071

[22] Filed: Jan. 28, 1983

[51] Int. Cl.[3] ..... H01H 9/00

[52] U.S. Cl. ..... 200/5 A; 200/86 R; 200/159 B

[58] Field of Search ..... 200/5 A, 86 R, 159 B, 200/292, 305

[56] References Cited

U.S. PATENT DOCUMENTS

| | | | |
|---|---|---|---|
| 3,668,337 | 6/1972 | Sinclair | 200/5 A |
| 4,035,593 | 7/1977 | Riniker | 200/5 A |
| 4,220,815 | 9/1980 | Gibson et al. | 200/86 R |
| 4,317,013 | 2/1982 | Larson | 200/5 A |

FOREIGN PATENT DOCUMENTS

| | | | |
|---|---|---|---|
| 0058849 | 9/1982 | European Pat. Off. | 200/5 A |
| 2903898 | 8/1979 | Fed. Rep. of Germany | 200/159 B |

*Primary Examiner*—A. D. Pellinen
*Assistant Examiner*—Morris Ginsburg
*Attorney, Agent, or Firm*—Cushman, Darby & Cushman

[57] ABSTRACT

A sensor switch comprising a printed circuit base board provided with a plurality of stationary contacts on a surface thereof and a flexible sheet member consisting of a rubber-like elastic material provided with a plurality of movable contact faces and protrusions and/or rail-like protrusions on one side and so piled on the printed circuit base board that each movable contact face is faced to the stationary contact respectively, in order to assure favorable operation touch, high reliability and easiness of practical equipment.

32 Claims, 16 Drawing Figures

SENSOR SWITCH

BACKGROUND OF THE INVENTION (a) Field of the Invention

The present invention relates to an improvement of a sensor switch, and particularly to the formation of a panel system sensor switch used for a write input means or a sensor switch useful for a thin key board means to perform an input by pressing down the upper surface of the switch with fingers or with another kind of pressing-down jig.

(b) Description of the Prior Art

Conventionally, a handwrite input means for personal computers is known as one of the write input means of the most simple formation. A sheet sensor switch panel used for this kind of input means is formed by so piling two sheets of polyester film uniformly applied with a carbon resistance body that the resistance bodies are facing each other by interposing therebetween micro dot-like spacers made of resin. The dots to be the spacers are protrusions of approximately 0.5 mm in diameter and approximately 50 μm in height and a number of them are integrally arranged on either surface of two sheets of polyester film facing each other with the spacing of approximately 5 to 6 mm.

By the way, in such formation, the root portion of dots will sink concavely because of fatigue when a write-in operation is repeated and, consequently, it has such a defect that mis-action is easy to happen through the contact of faced two resistance films caused even by the small vibration or the variation of temperature.

In case that the spacing between the dots adjacent each other is, for example, made so small as of 2.5 to 3 mm to improve this defect, a large pressing-down force will be necessary during the write-in operation. This will not only reduce the operability but also increase the fatigue of the surface of contact and it will result in the deterioration of the conductive performance.

Further, in this type of formation, because the distortion caused by the small variation of sizes and/or the temperature variation will come out as a bending of film face, there is a defect that a mis-action or short-circuit is easy to happen. Moreover, in a conventional formation, as the circumference of the root of dot is more difficult to deform than other parts, there is a defect that is not easy to elevate an input resolution.

SUMMARY OF THE INVENTION

A primary object of the present invention is to provide a sensor switch of the above-mentioned type without the above-mentioned defects.

According to the present invention, there is provided an ultra-thin sensor switch comprising a printed circuit base board having on the surface thereof at least a pair of stationary contacts, and a flexible sheet member made of a rubber-like elastic material and arranged on one side surface thereof with a movable contact face having a rubber-like elasticity and a plurality of protrusions and/or rail-like protrusions both made of an electro-insulating pliable rubber-like elastic material and so piled on the printed circuit base board that the movable contact face are faced to the stationary contacts through the space secured with the protrusions and/or rail-like protrusions, the protrusions and/or rail-like protrusions having such values as 10 to 70 of rubber hardness according to Physical Testing Methods for Vulcanized Rubber which is approved as Japanese Industrial Standard (hereafter, referred to as JIS K 6301), 0.05 to 0.5 mm in height and 0.1 to 2 mm in diameter or width, and being arranged with a spacing of 0.1 to 5 mm.

The sensor switch provided by the present invention is so arranged that, when the surface of the side opposed to the surface arranged with the protrusions and/or rail-like protrusions is pressed down by a finger tip, pen-like jig or the like in a form of concentrated load, the elastic deformation in the form of the bending or the flexure of the movable contact face will happen and, at the same time, at least a portion of the protrusions and/or rail-like protrusions will sink into the movable contact face and/or into the surface of the sheet member to support the movable contact face and, consequently, a portion of the movable contact face will touch without fail with the stationary contacts. Therefore, this sensor switch is able to be applied in such a wide range from a so-called touch sensor of the form of a thin key board means operable with a light action load by the finger tip to a so-called word input means or multi-item input means wherein only the co-ordinate signals of the position concentrated with a load by a pen-like jig are input.

Further, even when the vibration perpendicular to the surface of the sensor switch is added, there is no short-circuit problem, because all protrusions and/or rail-like protrusions absorb the vibration by deforming slightly. In this case, the deformed protrusions and/or rail-like protrusions will return to the original form since the deforming amount is necessarily small. Therefore, the reliability against the vibration and shock is extremely high.

Moreover, because the density per unit area of the protrusions and/or rail-like protrusions is able to be increased according to the necessity, not only the above-mentioned reliability is able to be improved still further, but also the movable contact face is able to be always maintained clean with no fear that the movable contact face will be touched by other members or by the fingers of a worker at assemblage. Therefore, the reliability at contact action is extremely high.

Further, the sensor switch provided by the present invention can be formed as a panel switch or knob switch so formed as the operating face is bended concavely or convexly, that is, so-called curled, because it has an extremely pliable flexibility as a whole. Moreover, according to the present invention, by use of a flexible display sheet or flexible PCB, a full key board of step type or sculpture type wherein a concave and convex are repeated is able to be displaced by a sensor switch key board highly reliable.

This and other objects of the present invention will become more apparent during the course of the following detailed description and appended claims.

DESCRIPTION OF THE PREFERRED EMBODIMENTS

Figure 1:
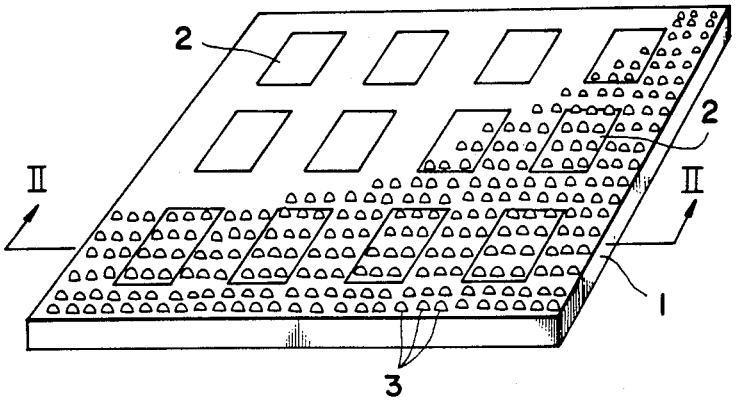
FIG. 1 is a perspective view showing an embodiment of a flexible sheet member having the movable contact face of the sensor switch according to the present invention.
Figure 2:
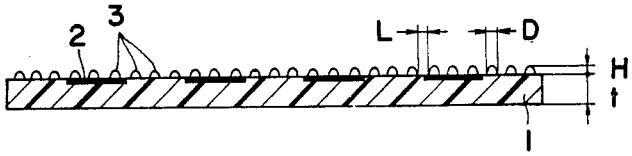
FIG. 2 is a sectional view of FIG. 1 along the II—II line.
Figure 3:
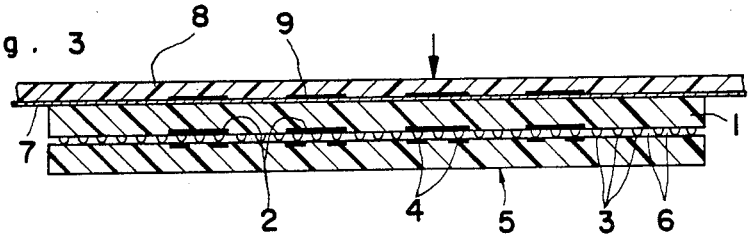
FIG. 3 is a longitudinally sectioned view showing an embodiment of the sensor switch according to the present invention.

Referring to FIGS. 1 to 3, the reference numeral 1 is a flexible sheet member made of a rubber-like elastic material provided with a plurality of rectangular flexible contact faces 2 arranged with regularity on one side surface and a plurality of columnar protrusions 3 arranged with regularity on the whole surface. In FIG. 1, a part of protrusions 3 is omitted to simplify the drawing.

The sheet member 1 is needed to have 20 to 100 of rubber hardness (JIS K 6301) and is made of a synthetic rubber or thermoplastic resin rubber-like elastic material. The flexible contact face 2 is obtainable by sticking, printing or offsetting electro-conductive synthetic rubber, electro-conductive synthetic resin or the like on the sheet member 1 as a ultra-thin molded member, or by sticking a metal thereon. In case that the contact face 2 is made of rubber-like elastic material and the rubber hardness thereof is within the above-mentioned range, the contact face 2 and sheet member 1 may be made of the same material. In this case, the whole surface of one side of the sheet member 1 will be the flexible contact face 2. When the thickness t (FIG. 2) of the sheet member 1 including the contact face 2 is over t=0.5 mm within 20 to 40 of rubber hardness (JIS K 6301) of the sheet member 1, over t=0.3 mm within 40 to 70, over t=0.2 mm within 70 to 80 and t=0.1 to 0.6 mm within 80 to 100, the compressing deformation of protrusion 3 described below in detail and the bending deformation of the contact face 2 will be produced in a well-balanced state and the elastic return after deformation will be done more smoothly. By the way, the sheet member 1 may be made of porous or foaming material to provide more pliable flexibility.

Figure 4:
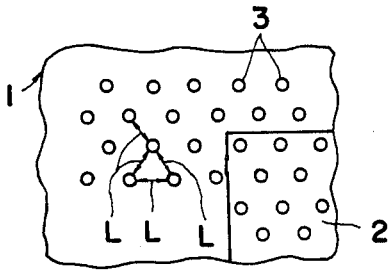
FIGS. 4 and 5 are partial plan views of the sheet member showing distributions of protrusions different from each other, respectively.

The protrusions 3 are so prescribed that it is made of electrically insulating pliable rubber-like elastic material and is within 10 to 70 in the rubber hardness (JIS K 6301), 0.05 to 0.5 mm in the height H (FIG. 2) and 0.1 to 5 mm in the spacing (a distance between protrusions adjacent each other) L (FIGS. 2 and 4). For the retention of favorable operation touch in the after-mentioned pressing-down operation and for the increase of possibility in the selection of operation area, the diameter D (FIG. 2) of the protrusions 3 is preferably 0.1 to 2 mm. These protrusions 3 are oridinally formed on the surface of the sheet member 1 of the side including the contact face 2 by means of the silk-screen process, printing with a paper pattern or plate pattern or combined method using both of them. As materials, room temperature-curable single-fluid type, two-fluid type or three-fluid type, or raised temperature-curable (curable at comparatively low temperature) single-fluid type, two-fluid type or three-fluid type silicon rubber compound which are viscous fluid at room temperature but rubber-like elastic body after curing will be used. Therefore, the protrusions 3 are able to be formed very efficiently. Further, as materials for the protrusion 3, it is able to use urethene resin, synthetic rubber liquid which is viscous fluid or latex, but silicon rubber is the most excellent in such points as of water repellence, cold-resistance, free from erosive action upon electric parts or the like. The protrusions 3 may be made of porous or foaming materials.

The present sensor switch is able to be produced by integrally piling the sheet member 1 having the contact face 2 and a plurality of protrusions 3 manufactured as mentioned above on the well known printed circuit base board 5 having a plurality of pairs of stationary contacts 4 so that the contact face 2 is opposed to respective pair of stationary contacts 4 and a space 6 is formed between them by means of the protrusions 3. As shown in FIG. 3, 7 is a thin film piled on the surface of the side opposite to the side having the contact face 2 and the protrusions 3 of the sheet member 1 and laminated with aluminium foil or electrically conductive material such as aluminium on one surface or on both surfaces. This film is grounded during the use of sensor switch and used to prevent static electricity troubles. 8 is a light passing cover film or sheet printed with push-position indices 9 such as the pressing-down area, symbol or the like on one side surface and covered on the ground film 7. The ground film 7 and the cover film or sheet 8 are able to be provided according to the necessity. Therefore, the push-position indices 9 may be provided directly on the surface of the side opposite to the side having the contact face 2 and protrusions 3 of the sheet member 1.

In the sensor switch manufactured in this way, as the push-position indices 9, contact face 2 and the stationary contacts 4 forming one set are all arranged, as shown in FIG. 3, by aligning them in the vertical direction, when the part indicated by the push-position index 9 is lightly pressed downwards (to the arrow-marked direction in FIG. 3) by finger or pen-like jig, the protrusions 3 which is in an extremely small area part corresponding to the pressing-down position will receive compressive deformation, and the contact face 2 will short between a pair of stationary contacts 4, 4 and close a circuit not illustrated. As the protrusions 3 will return quickly to the original shape when the pressing-down force is released, the space 6 will be again formed between the contact face 2 and stationary contacts 4 and the circuit will be opened. This pressing-down operation is able to be performed extremely lightly and softly and able to short without fail between the contacts even with a light touch.

Figure 5:
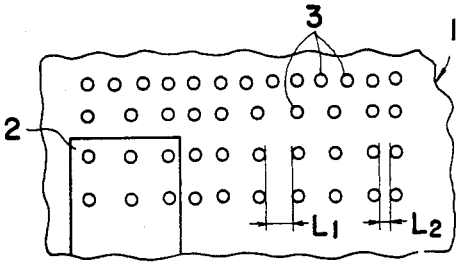
Figure 6:
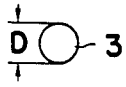
FIGS. 6 to 12 are plan views showing the shapes of protrusions different from each other, respectively.
Figure 7:
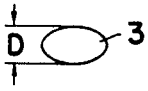
Figure 8:
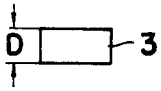
Figure 9:
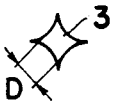
Figure 10:
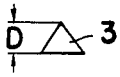
Figure 11:
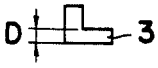
Figure 12:
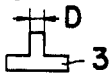
Figure 13:
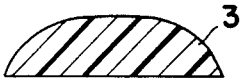
FIGS. 13 to 15 are longitudinally sectioned views showing the shapes of protrusions different from each other, respectively.
Figure 14:
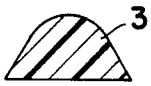
Figure 15:
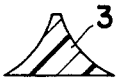

FIGS. 4 and 5 show the distribution different from each other of the protrusions 3. That is, FIG. 4 shows an example wherein the protrusions 3 are arranged so as to form a diagonal pattern by distributing them uniformly on the whole face of the sheet member 1 with a fixed spacing L, and FIG. 5 shows another example wherein the protrusions 3 are arranged with partially different distribution giving them two kinds of spacings $L_1$ and $L_2$ ($L_1 > L_2$) different from each other. In the area corresponding to the part wherein the protrusions 3 are arranged giving them the spacing $L_1$, as a required deformation of protrusions 3 is obtainable by the smaller pressing-down force than in the area corresponding to the area wherein they are arranged giving them the spacing $L_2$, it is easy to make a distinction between the area to be used for the pressing-down and the area another than that. The protrusion 3 is allowed to take various forms. That is, FIGS. 6 to 12 are exemplifying various shapes of protrusions 3 observed in the plan views different from each other, and FIGS. 13 to 15 are exemplifying various shapes of protrusion 3 observed in the cross-sectional views different from each other. That is, FIG. 6 is showing a columnar protrusion, FIG. 7 a oval or elliptical protrusion, FIG. 8 a rectangular protrusion, FIG. 9 a star-like protrusion having sharp angles, FIG. 10 a triangle protrusion, FIG. 11 an L-shaped protrusion and FIG. 12 a T-shaped protrusion. Further, FIG. 13 is showing a case wherein the shapes in the cross-sectional views of the part having the smallest width in the above-mentioned various shaped protrusions are forming a part of a circle, ellipse or cycloidal curve, FIG. 14 a case wherein it is forming a part of a parabola or hyperbola, and FIG. 15 a case wherein it is forming a mountain-shape having a sharp-angled tip. The size range concerning with the diameter D of protrusion 3 explained in reference to FIGS. 1 to 3 is basically applied to the smallest cross-sectional width, that is, in FIG. 7 the shorter diameter of the oval, in FIG. 8 the length of the shorter side of the rectangle, in FIG. 9 the length between two opposing concaved sides of the start, in FIG. 10 the length between one side and the apex opposing thereto of the triangle, in FIG. 11 the minimum length between opposing two side edges of L-shape and in FIG. 12 the minimum length between opposing two side edges of T-shape, in respect with the protrusions of various shapes exemplified in FIGS. 7 to 15 and the spacing L is applied to the closest spaces between the roots of adjacent protrusions. By the way, the above-mentioned various shapes of protrusion 3 does not limit the scope of the present invention.

The height H, diameter D and spacing L of protrusion 3 are important factors to decide the acting force and action means (finger-touch or the shape of pressing-down jig). That is, in case that the height H is within 0.05 to 0.5 mm and the spacing L is larger than 5 mm, the portion easy to act and the portion not easy to act within the pressing-down area are easy to be produced, the opposing contacts are easy to touch by the vibration or the like and the sensor switch is easy to misact. In this case, the preferred spacing L is 4 mm and less and still preferred spacing L is 3 mm and less. When the spacing L is less than 0.1 mm, as it becomes almost impossible to control the acting force because of the tolerance in the processing or molding operation, it is preferably 0.2 mm and over and still preferably 0.3 mm and over. In case that it is specifically desired to form a portion not easy to act by giving a partial variation in the distribution density of the protrusions 3, the spacing L may be 0.3 mm and less. In case that the height H is larger than 0.5 mm when the spacing L is within 0.1 to 5 mm, there will be a strange or irregular feeling, particularly at finger touch, caused by the unevenness and the feeling of pressing-down operation will be remarkably spoiled. Further, the compressing distortion of the contact face 2 and protrusions 3 within the large range of acting force will reduce the durable reliability of the sensor switch. Therefore, the height H of protrusion 3 is preferably 0.4 mm and less and still preferably 0.3 mm and less. Further, as, when the height H of protrusion 3 is less than 0.05 mm, the short-circuit owing to the dew and/or vibration is easy to occur and mis-action is also easy to happen, the height H of protrusion 3 is preferably 0.07 mm and over and still preferably 0.1 mm and over. In case that the protrusion 3 is within the above-mentioned size range and the cross-sectional shape thereof is such as shown in FIG. 2 and FIGS. 13 to 15, it has been confirmed by tests that a favorable operation touch is effectively obtainable. Moreover, as no unnatural distortion will be caused in protrusions when the protrusion is shaped in this way, it will greatly contribute to the promotion of durable reliability and to the increase of possibility in the selection of the operation area. The protrusion 3 may be made of the porous foaming material to provide with more pliable flexibility.

Figure 16:
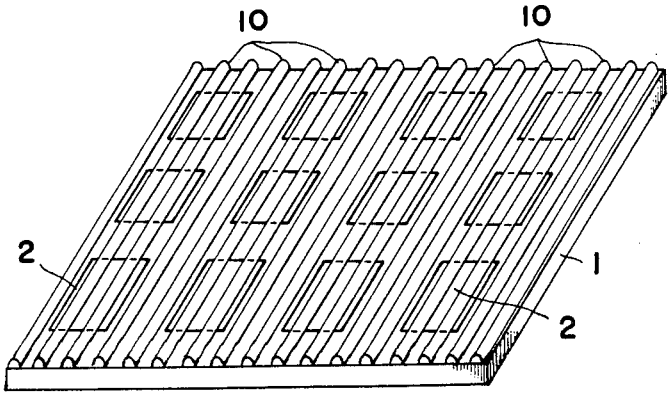
FIG. 16 is a perspective view showing another embodiment of the flexible sheet member having the movable contact face of the sensor switch according to the present invention.

The above is the explanation of an embodiment wherein the protrusions 3 are arranged on one side of the sheet member 1 to secure an air space 6. Rail-like protrutions arranged successively or at intervals with a predetermined spacing may be used in stead of protrusions 3. FIG. 16 is showing another embodiment wherein the rail-like protrusions 10 are arranged successively. In this embodiment, same numerals are given to the members substantially same to those shown in FIG. 1 and the detailed explanation on the material, size, shape and manufacturing method of respective member, and the size range of the height of protrusion, width (corresponding to the diameter D of columnar protrusion) and spacing between adjacent protrusions and the preferred range of correlative size is omitted, because they are perfectly same as those discussed about the protrution 3.

It is needless to say that a sensor switch having same advantages as of the embodiments already explained is able to be provided even when the protrusions 3 and rail-like protrusions 10 are arranged in combination. Therefore, such a formation belongs to the scope of the present invention.

I claim:

1. A sensor switch, comprising: a printed circuit base board provided on one side surface thereof with at least a pair of stationary contacts, and a flexible sheet member made of a rubber-like elastic material having a rubber hardness of 20 to 100 according to Physical Testing Methods for Vulcanized Rubber which is approved as Japanese Industrial Standard (hereafter, referred to as JIS K 6301) and provided on one side surface thereof with at least a movable contact face having a rubber-like elasticity and provided with a plurality of columnar protrusions made of an electrically insulating pliable rubber-like elastic material and so piled on said printed circuit base board that said movable contact face is faced to said stationary contacts with a space maintained by said protrusions, each of said protrusions being 10 to 70 in rubber hardness (JIS K 6301), 0.05 to 0.5 mm in height and 0.1 to 2 mm in diameter and being arranged adjacent each other with a spacing of 0.1 to 5 mm.

2. A sensor switch according to claim 1 further comprising an electrically conductive film piled on the surface opposing to the surface provided with said movable contact face of said flexible sheet member to prevent static electricity troubles.

3. A sensor switch according to claim 1 further comprising a light passing film piled on the surface opposing to the surface provided with said movable contact face of said flexible sheet member and having on one side surface thereof at least a push-position index.

4. A sensor switch according to claim 1 wherein the distribution density of said protrusions is partially different.

5. A sensor switch, comprising: a printed circuit base board provided on one side surface thereof with at least a pair of stationary contacts, and a flexible sheet member made of a rubber-like elastic material having a rubber hardness of 20 to 100 according to Physical Testing Methods for Vulcanized Rubber which is approved as Japanese Industrial Standard (hereafter, referred to as JIS K 6301) and provided on one side surface thereof with at least a movable contact face having a rubber-like elasticity and provided with a plurality of protrusions oval or elliptical in their cross-section made of an electrically insulating pliable rubber-like elastic material and so piled on said printed circuit base board that said movable contact face is faced to said stationary contacts with a space maintained by said protrusions, each of said protrusions being 10 to 70 in rubber hardness (JIS K 6301), 0.05 to 0.5 mm in height and 0.1 to 2 mm in shorter diameter and being arranged adjacent each other with a spacing of 0.1 to 5 mm.

6. A sensor switch according to claim 5 further comprising an electrically conductive film piled on the surface opposing to the surface provided with said movable contact face of said flexible sheet member to prevent static electricity troubles.

7. A sensor switch according to claim 5 further comprising a light-passing film piled on the surface opposing to the surface provided with said movable contact face of said flexible sheet member and having on one side surface thereof at least a push-position index.

8. A sensor switch according to claim 5 wherein the distribution density of said protrusions is partially different.

9. A sensor switch, comprising: a printed circuit base board provided on one side surface thereof with at least a pair of stationary contacts, and a flexible sheet member made of a rubber-like elastic material having a rubber hardness of 20 to 100 according to Physical Testing Methods for Vulcanized Rubber which is approved as Japanese Industrial Standard (hereafter, referred to as JIS K 6301) and provided on one side surface thereof with at least a movable contact face having a rubber-like elasticity and provided with a plurality of protrusions rectangular in their cross section made of an electrically insulating pliable rubber-like elastic material and so piled on said printed circuit base board that said movable contact face is faced to said stationary contacts with a space maintained by said protrusions, each of said protrusions being 10 to 70 in rubber hardness (JIS K 6301), 0.05 to 0.5 mm in height and 0.1 to 2 mm in length of the shorter side and being arranged adjacent each other with a spacing of 0.1 to 5 mm.

10. A sensor switch according to claim 9 further comprising an electrically conductive film piled on the surface opposing to the surface provided with said movable contact face of said flexible sheet member to prevent static electricity troubles.

11. A sensor switch according to claim 9 further comprising a light passing film piled on the surface opposing to the surface provided with said movable contact face of said flexible sheet member and having on one side surface thereof at least a push-position index.

12. A sensor switch according to claim 9 wherein the distribution density of said protrusions is partially different.

13. A sensor switch, comprising: a printed circuit base board provided on one side surface thereof with at least a pair of stationary contacts, and a flexible sheet member made of a rubber-like elastic material having a rubber hardness of 20 to 100 according to Physical Testing Methods for Vulcanized Rubber which is approved as Japanese Industrial Standard (hereafter, referred to as JIS K 6301) and provided on one side surface thereof with at least a movable contact face having a rubber-like elasticity and provided with a plurality of protrusions star-shaped in their cross-section made of an electrically insulating pliable rubber-like elastic materal and so piled on said printed circuit base board that said movable contact face is faced to said stationary contacts with a space maintained by said protrusions, each of said protrusions being 10 to 70 in rubber hardness (JIS K 6301), 0.05 to 0.5 mm in height and 0.1 to 2 mm in length between two opposing concaved sides and being arranged adjacent each other with a spacing of 0.1 to 5 mm.

14. A sensor switch according to claim 13 further comprising an electrically conductive film piled on the surface opposing to the surface provided with said movable contact face of said flexible sheet member to prevent static electricity troubles.

15. A sensor switch according to claim 13 further comprising a light-passing film piled on the surface opposing to the surface provided with said movable contact face of said flexible sheet member and having on one side surface thereof at least a push position index.

16. A sensor switch according to claim 13 wherein the distribution density of said protrusions is partially different.

17. A sensor switch, comprising: a printed circuit base board provided on one side surface thereof with at least a pair of stationary contacts, and a flexible sheet member made of a rubber-like elastic material having a rubber hardness of 20 to 100 according to Physical Testing Methods for Vulcanized Rubber which is approved as Japanese Industrial Standard (hereafter referred to as JIS K 6301) and provided on one side surface thereof with at least a movable contact face having a rubber-like elasticity and provided with a plurality of protrusions triangular in their cross-section made of an electrically insulating pliable rubber-like elastic material and so piled on said printed circuit base board that said movable contact face is faced to said stationary contacts with a space maintained by said protrusions, each of said protrusions being 10 to 70 in rubber hardness (JIS K 6301), 0.05 to 0.5 mm in height and 0.1 to 2 mm in length between one side and an apex opposed to said side and being arranged adjacent each other with a spacing of 0.1 to 0.5 mm.

18. A sensor switch according to claim 17 further comprising an electrically conductive film piled on the surface opposing to the surface provided with said movable contact face of said flexible sheet member to prevent static electricity troubles.

19. A sensor switch according to claim 17 further comprising a light passing film piled on the surface opposing to the surface provided with said movable contact face of said flexible sheet member and having on one side surface thereof at least a push-position index.

20. A sensor switch according to claim 17 wherein the distribution density of said protrusions in partially different.

21. A sensor switch, comprising: a printed circuit base board provided on one side surface thereof with at least a pair of stationary contacts, and a flexible sheet member made of a rubber-like elastic material having a rubber hardness of 20 to 100 according to Physical Testing Methods for Vulcanized Rubber which is approved as Japanese Industrial Standard (hereafter, referred to as JIS K 6301) and provided on one side surface thereof with at least a movable contact face having a rubber-like elasticity and provided with a plurality of protrusions L-shaped in their cross-section made of an electrically insulating pliable rubber-like elastic material and so piled on said printed circuit base board that said movable contact face is faced to said stationary contacts with a space maintained by said protrusions, each of said protrusions being 10 to 70 in rubber hardness (JIS K 6301), 0.05 to 0.5 mm in height and 0.1 to 2 mm in minimum length between two side edges opposed to each other and being arranged adjacent each other with a spacing of 0.1 to 5 mm.

22. A sensor switch according to claim 21 further comprising an electrically conductive film piled on the surface opposing to the surface provided with said movable contact face of said flexible sheet member to prevent static electricity troubles.

23. A sensor switch according to claim 21 further comprising a light passing film piled on the surface opposing to the surface provided with said movable contact face of said flexible sheet member and having on one side surface thereof at least a push-position index.

24. A sensor switch according to claim 21 wherein the distribution density of said protrusions is partially different.

25. A sensor switch, comprising: a printed circuit base board provided on one side surface thereof with at least a pair of stationary contacts, and a flexible sheet member made of a rubber-like elastic material having a rubber hardness of 20 to 100 according to Physical Testing Methods for Vulcanized Rubber which is approved as Japanese Industrical Standard (hereafter, referred to as JIS K 6301) and provided on one side surface thereof with at least a movable contact face having a rubber-like elasticity and provided with a plurality of protrusions T-shaped in their cross-section made of an electrically insulating pliable rubber-like elastic material and so piled on said printed circuit base board that said movable contact face is faced to said stationary contacts with a space maintained by said protrusions, each of said protrusions being 10 to 70 in rubber hardness (JIS K 6301), 0.05 to 0.5 mm in height and 0.1 to 2 mm in minimum length between two side edges opposed to each other and being arranged adjacent each other with a spacing of 0.1 to 5 mm.

26. A sensor switch according to claim 25 further comprising an electrically conductive film piled on the surface opposing to the surface provided with said movable contact face of said flexible sheet member to prevent static electricity troubles.

27. A sensor switch according to claim 25 further comprising a light passing film piled on the surface opposing to the surface provided with said movable contact face of said flexible sheet member and having on one side surface thereof at least a push-position index.

28. A sensor switch according to claim 25 wherein the distribution density of said protrusions is partially different.

29. A sensor switch, comprising: a printed circuit base board provided on one side surface thereof with at least a pair of stationary contacts, and a flexible sheet member made of a rubber-like elastic material having a rubber hardness of 20 to 100 according to Physical Testing Methods for Vulcanized Rubber which is approved as Japanese Industrial Standard (hereafter, referred to as JIS K 6301) and provided on one side surface thereof with at least a movable contact face having a rubber-like elasticity and provided with a plurality of rail-like protrusions made of an electrically insulating pliable rubber-like elastic material and so piled on said printed circuit base board that said movable contact face is faced to said stationary contacts with a space maintained by said protrusions, each of said protrusions being 10 to 70 in rubber hardness (JIS K 6301), 0.05 to 0.5 mm in height and 0.1 to 2 mm in width and arranged being adjacent each other with a spacing of 0.1 to 5 mm.

30. A sensor switch according to claim 29 further comprising an electrically conductive film piled on the surface opposing to the surface provided with said movable contact face of said flexible sheet member to prevent static electricity troubles.

31. A sensor switch according to claim 29 further comprising a light passing film piled on the surface opposing to the surface provided with said movable contact face of said flexible sheet member and having on one side surface thereof at least a push-position index.

32. A sensor switch according to claim 29 wherein the distribution density of said protrusions is partially different.

* * * * *